US009518456B2

(12) United States Patent
Balasubramanian et al.

(10) Patent No.: US 9,518,456 B2
(45) Date of Patent: Dec. 13, 2016

(54) COILED TUBING DEPLOYED GAS INJECTION MANDREL

(71) Applicant: SCHLUMBERGER TECHNOLOGY CORPORATION, Sugarland, TX (US)

(72) Inventors: Ganesh Balasubramanian, Singapore (SG); Yazid Mohamed Bashir, Singapore (SG); Bjorn Staale Varnes, Tau (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 538 days.

(21) Appl. No.: 14/062,348

(22) Filed: Oct. 24, 2013

(65) Prior Publication Data

US 2014/0116719 A1 May 1, 2014

Related U.S. Application Data

(60) Provisional application No. 61/719,815, filed on Oct. 29, 2012.

(51) Int. Cl.
*E21B 43/12* (2006.01)
*E21B 17/20* (2006.01)

(52) U.S. Cl.
CPC ..... *E21B 43/122* (2013.01); *E21B 17/20* (2013.01); *E21B 43/123* (2013.01)

(58) Field of Classification Search
CPC ..... E21B 43/122; E21B 43/123; E21B 17/20; Y10T 137/2934
See application file for complete search history.

(56) References Cited

U.S. PATENT DOCUMENTS 3,375,847 A * 4/1968 Brown ..... E21B 43/123 137/155
4,416,330 A 11/1983 Merritt et al.
4,498,533 A 2/1985 Johnston
4,505,331 A 3/1985 Akkerman
4,553,310 A 11/1985 Logan
5,170,815 A 12/1992 Going, III et al.
(Continued)

OTHER PUBLICATIONS

Search report for the equivalent GB patent application No. 1318938.6 issued on Apr. 15, 2014.

*Primary Examiner* — Shane Bomar
(74) *Attorney, Agent, or Firm* — Michael Stonebrook

(57) ABSTRACT

A coiled tubing gas injection mandrel includes a housing assembly capable of attachment to coiled tubing, wherein the housing assembly comprises an up-hole end, a down-hole end, a sleeve longitudinally integrally connected with the up-hole end and the down-hole end, and a slide-through valve receptacle assembly removably connected within the sleeve. In more detail, the slide-through valve receptacle assembly comprises an up-hole pipe with a shoulder, at least one laterally extending projection, at least one laterally extending port, a down-hole pipe integrally connected with the up-hole pipe, and a longitudinal bore within the up-hole pipe and down-hole pipe. The up-hole end and down-hole end are capable of attachment with coiled tubing. The slide-through valve assembly and the sleeve form a gas flow passageway, wherein the gas flow passageway controls the flow of gas through a gas lift valve installed in the slide-through valve receptacle for gas being injected into the coiled tubing.

20 Claims, 3 Drawing Sheets

(56) References Cited

U.S. PATENT DOCUMENTS

| | | | | |
|---|---|---|---|---|
| 5,427,133 | A * | 6/1995 | Pringle | E21B 17/20 137/155 |
| 5,469,878 | A * | 11/1995 | Pringle | E21B 17/20 137/155 |
| 5,782,261 | A | 7/1998 | Becker et al. | |
| 6,070,608 | A * | 6/2000 | Pringle | E21B 34/066 137/155 |
| 6,776,240 | B2 * | 8/2004 | Kenison | E21B 23/03 137/596.2 |
| 6,810,955 | B2 | 11/2004 | Roth et al. | |

* cited by examiner

COILED TUBING DEPLOYED GAS INJECTION MANDREL

CROSS-REFERENCE TO RELATED APPLICATION

This Application claims priority to U.S. Provisional Patent Application Ser. No. 61/719,815, filed Oct. 29, 2012, which is hereby incorporated by reference in its entirety.

TECHNICAL FIELD

The field of the disclosure relates generally to mandrels for gas lift systems, and more particularly, to a coiled tubing gas injection mandrel which allows gas lift through the annular region created between coiled tubing and production tubing.

BACKGROUND

For purposes of communicating well fluid to a surface of a well, such as an oil or gas well, a well may include production tubing. Often times, to enhance the rate at which fluid is produced through the production tubing, an artificial-lift technique is employed. One such technique involves injecting gas into the production tubing to displace some of the well fluid in the tubing with lighter gas. The displacement of the well fluid with the lighter gas reduces the hydrostatic pressure inside the production tubing and allows reservoir fluids to enter the wellbore at a higher flow rate. The gas to be injected into the production tubing typically is conveyed down hole via an annulus and enters the production tubing through one or more gas lift barrier valves.

There are a number of problems that can develop in a producing well that can negatively affect operations, production and ultimately revenue generated, such as failure of mechanical equipment, changes in production characteristics, plugging and increases in injection pressure. After a well goes into production, these events may occur, requiring modification of the well in order to achieve optimal production; this is called well intervention. For example, in many older wells, gas lift systems cannot be used without removing the production tubing to place mandrels and valves. This is also the case in wells where the original gas lift systems are no longer functioning or functioning incorrectly. Coiled tubing has often been used in well intervention because the flexibility of the tubing allows the tubing to be placed into the well inside the already existing production tubing, thus, coiled tubing is often used as a retrofit to fix issues.

Gas lift assemblies attached to coiled tubing, such as the one disclosed in U.S. Pat. No. 5,170,815, are known in the art. Nevertheless, the known assemblies fail to offer flexibility in the choice of gas lift valve. Thus, in an effort to optimize a gas lift system, there exists a continuing need to provide gas lift in a flexible system, whereby older wells can be retrofitted with the appropriate valve for the application.

SUMMARY

The following is brief summary of a combination of embodied features and is in no way meant to unduly limit any present or future claims relating to this disclosure.

In an embodiment, a coiled tubing gas injection mandrel includes a housing assembly capable of attachment to coiled tubing. The housing assembly comprises an up-hole end, a down-hole end, a sleeve longitudinally integrally connected with the up-hole end and the down-hole end, and a slide-through valve receptacle assembly removably connected within the sleeve. The coiled tubing gas injection mandrel is adapted to be connected to coiled tubing, where the coiled tubing will be deployed into production tubing of a well and gas injection will be performed through the coiled tubing.

The slide-through valve receptacle assembly is configured with an up-hole pipe, a shoulder, at least one laterally extending projection, at least one laterally extending port, a down-hole pipe integrally connected with the up-hole pipe, and a longitudinal bore within the up-hole pipe and down-hole pipe such that the slide-through valve receptacle assembly removably mates with the sleeve to form a flow path passageway. This flow path passageway provides for control of gas injection for gas lift.

In one embodiment, a method of using the coiled tubing gas injection mandrel for coiled tubing gas lift is contemplated.

BRIEF DESCRIPTION OF THE DRAWINGS

The description references the accompanying figures.

DETAILED DESCRIPTION

Figure 1:
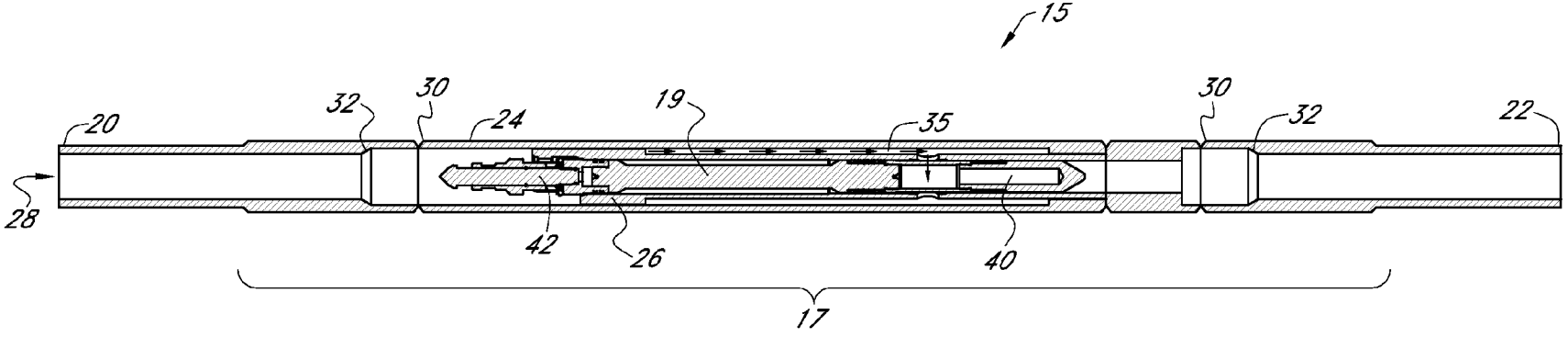
FIG. 1 is a side sectional schematic view of a coiled tubing gas injection mandrel containing an installed gas lift valve and latch assembly installed. The coiled tubing gas injection mandrel is connected to coiled tubing (not shown) inside production tubing (not shown).

In the following description, numerous details are set forth to provide an understanding of present embodiments. However, it will be understood by those skilled in the art that the present embodiments may be practiced without many of these details and that numerous variations or modifications from the described embodiments are possible. This detailed description is not meant in any way to unduly limit any present or future claims relating to the present disclosure.

As used here, the terms "above" and "below"; "up" and "down"; "upper" and "lower"; "upwardly", "downwardly"; "up-hole" and "down-hole" and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

An example coiled tubing gas injection mandrel (CT-GIM) is described. Referring now to the drawings, the reference numeral 15 generally indicates the coiled tubing gas injection mandrel. The mandrel includes a housing assembly 17. Many of the figures also demonstrate a gas lift valve and latch assembly 19.

As shown in FIG. 1, housing assembly 17 has an up-hole end 20 and a down-hole end 22, wherein the ends are adapted to be connected to coiled tubing (not shown), a sleeve 24, a valve receptacle 26 and a bore 28 there through.

In one embodiment, both up-hole end 20 and down-hole end 22 are threaded such that housing assembly 17 can be connected to coiled tubing via threading. The type of threading of ends 20 and 22 is not meant to be limiting and can be one of a number of known threadings. For example the threading regions of the ends can be designed to accommodate a suitable thread type such as VAM, EUE, Tenaris, etc. It is advantageous for the threading to provide generally leakproof seals. In another embodiment, ends 20 and 22 will be connected to the coiled tubing by full penetration welding into the coiled tubing.

In certain embodiments, only up-hole end 20 will be connected to coiled tubing. In these embodiments, down-hole end 22 will be left as a free end. If down-hole end 22 is meant to be a free end, it may or may not have appropriate threading.

Up-hole end 20 and down-hole end 22 may be separately swaged and connected to sleeve 24 of housing assembly 17 by circumferential welds. For example, in the embodiment shown in FIG. 1, weld joints 30 are shown. In one embodiment up-hole end 20 and down-hole end 22 transition in internal diameter from small to large, on the up-hole end of the mandrel body, and from large back to small, on the down-hole end of the mandrel body. Typically, that is, each end has a large end which matches the diameter of the sleeve, and a small end that matches the diameter of the coiled tubing. In one embodiment, the external diameter of up-hole end 20 and down-hole end 22 also transitions from small to large on the up-hole end of the mandrel body and from large back to small on the down-hole end of the mandrel body. The wider external diameter aligns with sleeve 24 and valve receptacle 26 for welding. The narrowing external diameter aligns with the threading, as determined by the blanking dimensions, of the coiled tubing. However, in other embodiments, the outer diameter of up-hole end 20 and down-hole end 22 remain constant. Furthermore, up-hole end 20 and down-hole end 22 may include chamfers 32 in certain embodiments. Chamfers 32 are not required; however, they may be advantageous in that they eliminate sharp edges where slickline or wireline tools could potentially get stuck.

Figure 2:
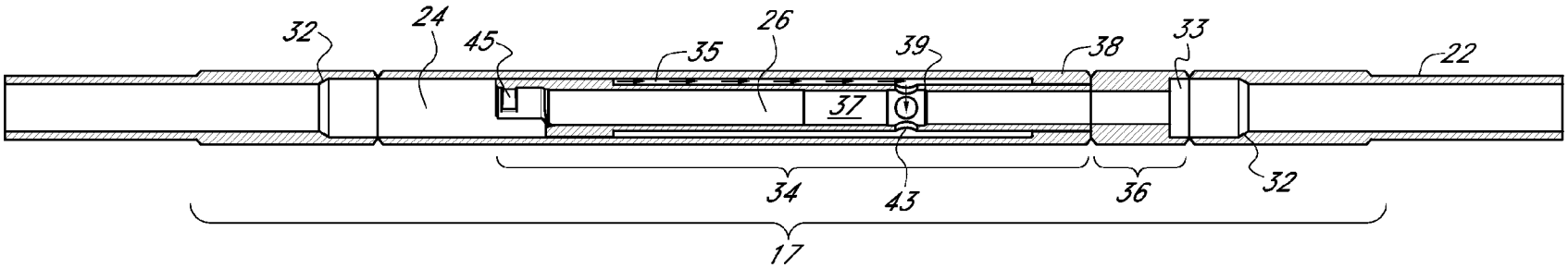
FIG. 2 is a side sectional schematic view of a coiled tubing gas injection mandrel without an installed gas lift valve and latch assembly.

As best demonstrated by FIG. 2, the main body of housing assembly 17 is formed by sleeve 24 and longitudinally oriented valve receptacle 26. As used herein, valve receptacle is equivalent to valve receptacle assembly and slide-through valve receptacle assembly. In the embodiment demonstrated in the figures, valve receptacle 26 has up-hole pipe 34 and down-hole pipe 36. In one embodiment, valve receptacle 26 is a receptacle that is placed into sleeve 24 by sliding it through until the down-hole end 33 of valve receptacle 26 contacts down-hole end 22. Slide-through valve receptacle 26 is then connected with sleeve 24 on the up-hole end 20 and down-hole end 22 on the down-hole end. In one embodiment, down-hole portion of valve receptacle 26 provides an outside diameter for valve receptacle 26 to be welded to down-hole end 22.

Valve receptacle 26 is placed into sleeve 24 such that gas can travel (demonstrated by arrows) from the coiled tubing to at least one flow path passageway 35 between the inside of sleeve 24 and the outside of valve receptacle 26. In one embodiment, flow path passageway 35 runs along a length of sleeve 24. For example flow path passageway 35 may be about 75% of the longitudinal length of sleeve 24. In another embodiment, flow path passageway 35 may be about 85% of the longitudinal length of sleeve 24.

The inside of valve receptacle 26 may be a uniform diameter in one embodiment. Nevertheless, in the embodiment demonstrated by FIG. 2, valve receptacle 26 has portion 37, which is smaller in internal diameter as compared to the up-hole portion of up-hole pipe 34, in order to accommodate valve packing. The remaining down-hole portion of up-hole pipe 34 may also be smaller in internal diameter. Valve receptacle assembly 26 may also include chamfer 39 in individual embodiments. Generally, chamfer 39 will be 45 degrees although other degrees of beveling are contemplated. Chamfer 39 assists in smooth travel of valve assembly 19 into and out of valve receptacle 26.

In one embodiment, sleeve 24 has at least one down-hole sleeve projection 38, which extends to contact the outside of valve receptacle 26. This forms a seal between the inside of sleeve 24 and the outside of valve receptacle 26, which requires that gas injection results in injected gas flowing through the valve if a valve is placed into valve receptacle 26. In one embodiment, valve receptacle 26 is welded to down-hole sleeve projections 38.

Referring back to FIG. 1, valve receptacle 26 is adapted to receive a gas lift valve assembly 19 within bore 28 between up-hole end 20 and down-hole end 22. Generally a gas lift valve assembly includes a flow control device such as a gas lift valve 40 and a latch assembly 42. As shown by arrows in FIG. 1 and FIG. 2, which demonstrate the flow path for injected gas, sleeve 24 and valve receptacle 26 create at least one flow path passageway 35 for the gas from the coiled tubing to pass through gas lift valve 40. The size requirements for flow path passageway 35 depend on the gas injection rate and will generally be determined by the field application engineer for the particular well. In one embodiment, latch assembly 42 for gas lift valve 40 is attached to valve receptacle 26 by latch lug 45 such as the one best demonstrated in FIG. 2. In this embodiment, latch lug 45 is machined into slide-through valve receptacle 26 for a valve top latch. However, in other embodiments, latch assembly 42 may be attached to valve receptacle 26 using any device known in the art to secure gas lift valves inside a mandrel.

Figure 4:
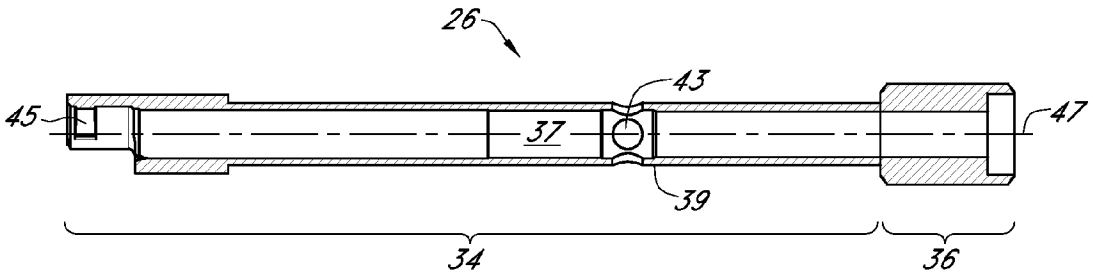
FIG. 4 is a side view of the inside of the slide-through pocket of the coiled tubing gas injection mandrel.
Figure 5:
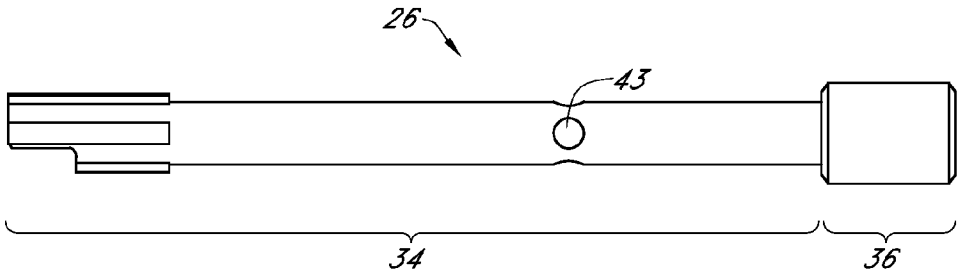
FIG. 5 is a side view of the outside of the slide-through pocket of the coiled tubing gas injection mandrel.
Figure 3:
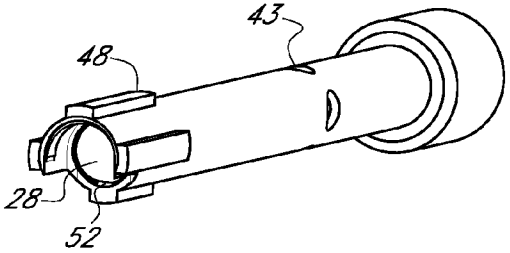
FIG. 3 is a perspective front view of the outside of the slide through pocket of the coiled tubing gas injection mandrel.

Slide through valve receptacle 26 is shown in more detail in FIGS. 3-5. Valve receptacle 26 can be custom designed to have bore 28 size of about 1 inch, about 1.5 inch, or about 1.75 inch, enabling the valve bore to accommodate any of these three sizes of commercially available gas lift valves. Nevertheless, various other profiles are contemplated depending on the type of well application requirements.

Valve receptacle 26 has at least one laterally extending port 43 for the passage of gas from flow path passageway 35 into the through bore 28 of valve receptacle 26. Generally, such as in the embodiments shown in FIGS. 3-5, through bore 28 will be cylindrical in shape. Nevertheless, in certain embodiments, through bore 28 may be different shapes, such as keyhole. The longitudinal axis of through bore 28 is represented by reference numeral 47. Longitudinal axis 47 is generally aligned parallel to sleeve 24 and the coiled tubing.

Down-hole pipe 36 of slide-through valve receptacle 26 is formed such that the down-hole pipe 36 interacts with down-hole end 22 of housing assembly 17. In many cases, down-hole pipe 36 will be welded to down-hole end 22.

As also demonstrated best by FIGS. 3-5, in this embodiment, valve receptacle 26 has shoulder 52 and at least one laterally extending projection 48. Shoulder 52 is adapted to support the slide-through pocket against bending loads. Laterally extending projections 48 are adapted to mate with the inside of sleeve 24 and hold valve receptacle 26 in place.

One advantage of the CT-GIM is it allows coiled tubing deployment along with coiled tubing gas injection. In most embodiments, the coiled tubing is deployed within production tubing. Thus, the CT-GIM provides gas lifting through the annular region created between the coiled tubing and the production tubing.

The example coiled tubing gas injection mandrel can be used in Coil Tubing Inverted Gas Lift Systems (IGLS). In one embodiment, the mandrel enables introduction of a gas lift system into non-gas lift wells. As a means for increased well recovery, IGLS can be introduced in both existing gas lift wells and also in standard production wells that are ready for gas lift. Also, an Inverted Gas Lift System may be required in an existing gas lift well if existing gas lift equipment fails to perform.

An example IGLS system may consist of a CT hanger, a suspension hanger, a dual flow safety valve and the disclosed coiled tubing gas injection mandrel with a pre-installed gas lift valve. In one embodiment, the CT-GIM is installed with 5.5 inch coiled tubing. In another embodiment, the CT-GIM is installed with 7 inch coiled tubing. The system installation operation can be achieved with a well intervention rig.

Although generally only one CT-GIM will be placed into an individual well to provide gas lift at a particular position, it is to be understood that in any individual well one or more of the CT-GIM may be vertically connected to the coiled tubing and spaced from each other. The disclosed CT-GIM illustrates the method of injecting lift gas downwardly through the mandrel and discharging through each gas fit assembly and through the bottom of the mandrel into the production tubing thereby lifting well fluids in the annulus between the production tubing and the coiled tubing.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A coiled tubing gas injection mandrel, comprising a housing assembly capable of attachment to coiled tubing, wherein the housing assembly comprises an up-hole end, a down-hole end, a sleeve longitudinally integrally connected with the up-hole end and the down-hole end, and a slide-through valve receptacle assembly removably connected within the sleeve so as to define a flow path passageway extending from the up-hole end of the housing to the down-hole end of the housing between an exterior of the slide-through valve receptacle and an interior of the sleeve.

2. The coiled tubing gas injection mandrel of claim 1 wherein the up-hole end, down-hole end and sleeve are a welded assembly.

3. The coiled tubing gas injection mandrel of claim 1 wherein the housing assembly is connected to a coiled tubing through the up-hole end.

4. The coiled tubing gas injection mandrel of claim 3 further wherein the housing assembly is connected to a coiled tubing through the down-hole end.

5. The coiled tubing of claim 3 wherein the coiled tubing gas injection mandrel is connected with the coiled tubing as a threaded assembly.

6. The coiled tubing gas injection mandrel of claim 1 wherein the slide-through valve receptacle assembly is capable of housing a gas lift valve and latch assembly.

7. The coiled tubing gas injection mandrel of claim 1 wherein the connection between the sleeve and the slide-through valve receptacle assembly forms a flow path passageway.

8. The coiled tubing gas injection mandrel of claim 1 wherein the sleeve and slide-through valve receptacle assembly are removably connected by a sleeve projection and slide-through valve receptacle assembly laterally extending projection.

9. The coiled tubing gas injection mandrel of claim 1 wherein the slide-through valve receptacle assembly comprises an up-hole pipe, wherein the up-hole pipe comprises a shoulder, at least one laterally extending projection, at least one laterally extending port, a down-hole pipe integrally connected with the up-hole pipe, and a longitudinal bore within the up-hole pipe and down-hole pipe.

10. The coiled tubing gas injection mandrel of claim 6 further comprising a gas lift valve within the slide-through valve receptacle assembly.

11. The coiled tubing gas injection mandrel of claim 10 wherein the gas lift valve is connected with the slide-through valve receptacle assembly through a latch assembly.

12. The coiled tubing gas injection mandrel of claim 11 wherein the latch assembly comprises a latch lug.

13. The coiled tubing gas injection mandrel of claim 10 wherein gas is capable of flowing from a bore in the up-hole end into the sleeve, into a gas flow chamber and then through the valve into the down-hole end.

14. The coiled tubing gas injection mandrel of claim 1 wherein the coiled tubing gas injection mandrel is deployable into production tubing using a coiled tubing.

15. A system comprising production tubing, coiled tubing and a coiled tubing gas injection mandrel connected with the coiled tubing, the coiled tubing gas injection mandrel comprising:

a sleeve;

a slide-through valve receptacle assembly disposed within the sleeve; and a flow path passageway formed between an interior of the sleeve and the slide-through valve receptacle assembly, wherein gas is injected through the coiled tubing and flow path passageway of the coiled tubing gas injection mandrel before being discharged into the production tubing.

16. The system of claim 15, wherein the coiled tubing gas injection mandrel enables gas lift through an annular region between the coiled tubing and the production tubing.

17. The system of claim 15, wherein the flow path passageway defines a flow path for an injected gas, enabling the injected gas flow to be regulated through an installed gas lift valve.

18. A method of performing gas lift in a production well comprising injecting gas through a coiled tubing and a coiled tubing gas injection mandrel, the coiled tubing gas injection mandrel comprising:

a sleeve;

a slide-through valve receptacle assembly disposed within the sleeve; and a flow path passageway extending from above the slide-through valve receptacle assembly to below the slide-through valve receptacle assembly and between an interior of the sleeve and an exterior of the slide-through valve receptacle assembly, wherein the coiled tubing and the coiled tubing gas injection mandrel are within a production tubing.

19. The method of claim 18 wherein the coiled tubing gas injection mandrel comprises a housing assembly capable of attachment to coiled tubing, wherein the housing assembly comprises an up-hole end, a down-hole end, the sleeve longitudinally integrally connected with the up-hole end and the down-hole end, and the slide-through valve receptacle assembly removably connected within the sleeve.

20. The method of claim 19 wherein the slide-through valve receptacle assembly comprises an up-hole pipe, wherein the up-hole pipe comprises a shoulder, at least one laterally extending projection, at least one laterally extending port, a down-hole pipe integrally connected with the up-hole pipe, and a longitudinal bore within the up-hole pipe and down-hole pipe.

* * * * *